United States Patent [19]

Wahhoud et al.

[11] Patent Number: 4,905,741

[45] Date of Patent: Mar. 6, 1990

[54] WEFT THREAD INSERTING DEVICE FOR PNEUMATIC LOOMS

[75] Inventors: Adnan Wahhoud, Lindau-Bodolz; Rudolf Riezler, Nonnenhorn, both of Fed. Rep. of Germany

[73] Assignee: Lindauer Dornier Gesellschaft mbH, Lindau/Bodensee, Fed. Rep. of Germany

[21] Appl. No.: 278,222

[22] Filed: Nov. 30, 1988

[30] Foreign Application Priority Data

Dec. 1, 1987 [DE] Fed. Rep. of Germany ..... 3740666

[51] Int. Cl.[4] ..... D03D 47/30

[52] U.S. Cl. ..... 139/435 E; 139/302

[58] Field of Search ..... 139/194, 435, 302, 370.2

[56] References Cited

U.S. PATENT DOCUMENTS 4,498,504 2/1985 Allen et al. ..... 139/194

4,553,570 11/1985 Moessinger et al. ..... 139/435

FOREIGN PATENT DOCUMENTS 184435 11/1986 European Pat. Off. .

3415052 10/1985 Fed. Rep. of Germany .

204949 11/1984 Japan ..... 139/435

*Primary Examiner*—Henry S. Jaudon

*Attorney, Agent, or Firm*—W. G. Fasse; D. H. Kane, Jr.

[57] ABSTRACT

A pneumatic loom having at least two blow nozzles arranged in a bundle, is equipped with a weft thread insertion alignment device (2) located in a fixed position between the blow nozzles and the weft thread guide channel formed by the reed teeth. The alignment device (2) has an alignment slot having a funnel-shape receiving the weft threads at a wide inlet opening and leading the weft threads to a narrower outlet opening. The alignment slot extends along at least a portion of the path followed by the reed teeth on their beat-up motion. One end of the alignment slot is open toward the weft thread cutting scissors for exit of the weft threads. Weft threads waste is kept very low by the location of all relevant components close to each other. The effectiveness of the scissors is not impaired at all. The time available for the weft thread insertion is increased which means that the r.p.m. of the loom can be increased.

8 Claims, 6 Drawing Sheets

WEFT THREAD INSERTING DEVICE FOR PNEUMATIC LOOMS

FIELD OF THE INVENTION

The invention relates to a weft thread inserting device for pneumatic looms. More specifically, the invention relates to looms having at least two blowing nozzles for inserting the weft thread into the loom shed. The nozzles are arranged to form a nozzle bundle.

BACKGROUND INFORMATION

Conventionally, the weft thread blowing nozzles are arranged to pivot or tilt with the reed of the loom. It is also conventional to arrange a funnel shaped alignment device between the nozzles and the entrance to a weft thread guide channel formed by the teeth of the reed. Such a conventional alignment device has an inlet funnel opening corresponding to the full diameter of the nozzle bundle and an outlet diameter corresponding substantially to the reduced cross-sectional width of the alignment device.

This type of alignment device has certain drawbacks, especially where for multi-color weaving an individual weft thread insertion nozzle is provided for each thread having a different color. These insertion nozzles are collected into a bundle and the blow fluid mixing pipes of the individual nozzles are arranged with equal spacing from the loom shed.

Pneumatic looms are also equipped with means for forming weft thread guide channels. For this purpose it is, for example, conventional to equip the reed of the loom with reed teeth having profiled projections for forming the guide channel. These projection confine the guide channel from above and from below leaving one side of the channel open for the beat-up of the weft thread. The available cross-sectional area of so formed guide channels is relatively small and this is desirable for assuring a proper guiding of the weft thread as it is being inserted and also for keeping the quantity of blowing medium for the weft thread insertion as small as possible. It is also desirable that the weft thread is always travelling through the guide channel along the same path which additionally shall be the most advantageous path. In looms weaving multi-colored fabrics a plurality of weft thread insertion nozzles are arranged in a bundle for the insertion of threads having different colors. It is this type of arrangement of the blow nozzles which prevent satisfying without difficulties the double requirement that the travel path through the guide channel shall always be the optimal path and always the same path for all threads. Thus, attempts have been made to arrange the nozzles in a displaceable manner or to arrange them in a revolving manner so that it would be possible to bring the nozzle of the selected weft thread into the most advantageous position from which the nozzle previously occupying that position had to be removed. This solution to the above mentioned problem requires a complicated and hence costly construction. Due to its complicated movable components the construction is sensitive to external influences and it is trouble-prone.

Even if only a few individual nozzles are assembled into a compact bundle, the available cross-sectional area of the guide channel is frequently insufficient in order to be able to mount the nozzle bundle in a fixed location. This is so because the fluid flows from the individual nozzles travel through the guide channel along flow paths which differ from one another and, at least partially are not following the most advantageous path through the guide channel. Frequently, the thread end impacts on the edges of the reed teeth which define the guide channel. As a result, a substantial proportion of the kinetic energy exerted by the fluid flow is lost so that the thread insertion speed is impaired and the insertion time is lengthened. Further, it is quite possible in conventional devices that the thread being inserted is snarled or jammed up with all the disadvantageous consequences, for example, the formation of undesired loops. Thus, it is not possible to achieve an optimal weft thread insertion where a plurality of weft thread inserting nozzles are arranged in fixed positions because from these positions it is not possible to cause each weft thread to follow the most advantageous path through the guide channel.

To avoid the above problems European Patent Publication 184,435 discloses an arrangement in which the mutual location of the blowing nozzles in the bundle relative to each other is fixed and wherein the flow direction or movement direction of the fluid flow out of each nozzle is individually influenced for directing the respective weft thread advantageously into the guide channel. The just mentioned European Patent Publication 184,435 discloses a weft thread insertion mechanism for looms capable of weaving multi-colored fabrics. The bundle of nozzles is provided with a centrally located fluid flow guide body having an elongated shape with a diameter that first increases in the flow direction and then again decreases. A fluid flow coming out of one of the nozzles follows the shape or contour of the fluid flow guide body so that the weft thread is accordingly deflected, thereby bringing the weft thread approximately into a path through the center of the nozzle bundle. This type of arrangement intends to make sure that a weft thread to be inserted will always take up the same position or rather follow the same path within the guide channel independently of the particular nozzle which inserted the thread. As a result, the cross-section of the guide channel can remain relatively narrow. However, it is a disadvantage of this type of arrangement that the degree of fluid flow deflection depends on the flow speed and thus on the pressure of the available flow medium. Further, the flow guide body must be relatively large while the obtainable effect is not so strong that the required deflection angles for the weft threads are achieved when the nozzle bundle is large as is the case where threads of different colors are to be inserted for the weaving of the multi-colored fabrics. The particular shape of the central flow guide body has a great influence on the weft thread insertion with the added disadvantage that the influence depends on the type of thread involved. Threads with a smooth surface are, for example, influenced in a different way than threads with a rough or coarse surface.

German Patent Publication (DE-OS) 3,415,052 describes another device in which several blowing nozzles are collected into a bundle and a special mechanism is provided for the clean weft thread insertion into the guide channel in the reed. The bundle of blowing nozzles is secured to the loom sley so that the nozzle bundle pivots with the loom sley. However, the individual position of the nozzles relative to each other within the bundle remains unchanged. the guide channel is formed by upper and lower rows of projections of the reed teeth forming the reed. The special mechanism referred to as alignment aid is arranged between the guide channel of the reed and the blowing nozzles. This mechanism comprises a body having a funnel-shaped bore with a funnel-shaped opening facing the blowing nozzles and an exit opening facing the guide channel. The diameter of the funnel opening corresponds at least to the total diameter of the blow nozzle bundle. The diameter of the exit opening corresponds approximately to the cross-sectional width of the U-shaped guide channels through the reed. The blow nozzles, or rather the bundle of blow nozzles and the alignment aid are secured to the reed beam so that they tilt or pivot together with the weaving reed. The alignment aid makes sure that the weft thread entry into the guide channel is centered for all blowing nozzles of the bundle. After the weft thread has been inserted, it is cut at the moment of the reed beat-up. The cutting takes place either between the reed and the alignment aid or between the blow nozzles and the alignment aid. Thus, at least on one side of the alignment aid a certain spacing is required between the alignment aid and the neighboring component, namely the nozzles or the reed in order to provide room for the weft thread cutting element such as a scissors and possibly also for a weft thread clamp. The disadvantage of this conventional arrangement is seen in that the weft thread waste is substantial due to the required location of the weft thread cutting scissors.

The above mentioned German Patent Publication (DE-OS) 3,415,052 also discloses that the bundle of blow nozzles can be mounted in a fixed position and only the alignment aid is mounted to the reed for tilting with the reed. In such an arrangement the weft thread insertion can take place only when the blowing nozzle, the funnel-shaped alignment aid, and the reed channel are arranged in alignment with one another. This situation is present only for a very short time and that available time may be too short for the proper weft thread insertion.

OBJECT OF THE INVENTION

In view of the above it is the aim of the invention to achieve the following objects singly or in combination:

- to avoid the drawbacks of the prior art, more specifically to provide a longer time period for the weft thread insertion during each machine revolution;
- to optimally reduce the weft thread waste;
- to make sure that the weft thread of each of a plurality of blow nozzles is inserted into the guide channel along the most advantageous guide path and that such guide path is the same for all weft threads;
- to avoid any damage to the weft thread cutting scissors; and
- to construct the weft thread alignment device in such a way that it can be mounted in a stationary position to avoid moving or pivoting the alignment device with the reed.

SUMMARY OF THE INVENTION

The weft thread inserting mechanism according to the invention is equipped with an alignment device for the weft threads as they emerge from the blow nozzles, wherein the alignment device is characterized in that it is located in a space directly between the blow nozzles and the reed so that it bridges this space while it is mounted in a fixed position. The opening of the alignment device is formed as a funnel-type slot, whereby the slot length corresponds substantially to the distance through which the guide channel formed by the reed tilts during the pivoting or beat-up motion of the reed. The invention is applicable to all types of blow nozzles that are conventionally used for the insertion of the weft thread into the loom shed. The invention is also applicable to looms in which additional so-called relay nozzles are arranged within the loom shed for the further transport of the weft thread through the loom shed.

By mounting the alignment device in a stationary position the invention avoids that the alignment device could damage the weft thread scissors and/or weft thread clamps. The stationary mounting also has the advantage that masses to be moved are reduced and that even partial movements of the alignment device are avoided. Also, the construction is substantially simplified by the stationary mounting of the alignment device.

Another advantage of the invention is seen in that spacings between the nozzles and the alignment device on the one hand, and between the alignment device and the reed on the other hand can be substantially avoided so that the waste of weft thread material is reduced.

Additionally, the stationary position makes sure that the alignment device cannot cause any damage to the weft thread scissors. By making the alignment slot elongated to such an extent that the length of the alignment slot corresponds approximately to the pivoting motion of the reed, or at least to part of that pivoting motion, it is possible for the alignment device to perform at least part of the weft thread insertion during the pivoting motion of the reed, even though the alignment device is stationary. This feature has the important advantage that the time available for the weft thread insertion is increased along with the machine rotational angle which is substantially enlarged.

By making the alignment slot with an open end toward the weft thread scissors, or rather toward the beat-up side, the beat-up of the weft thread can be performed without any difficulties. If desired, a weft thread guide bail may be provided between the alignment device and the weft thread scissors so that the weft thread is properly guided at all times until it is properly beat-up.

The depth of the alignment slot,that is the thickness of the alignment body in the weft thread inserting direction, can even be reduced if a portion of the funnel-shaped opening is located into the initial or lead-in portion of the reed guide channel. For this purpose, the reed teeth are provided with projections which are so located that a funnel-shaped configuration is provided for the inlet end of the reed guide channel. Preferably, this funnel-shaped lead-in end to the guide channel is formed by a set of reed teeth which form an auxiliary, separate reed. Such auxiliary separate reed may be located immediately next the alignment device.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
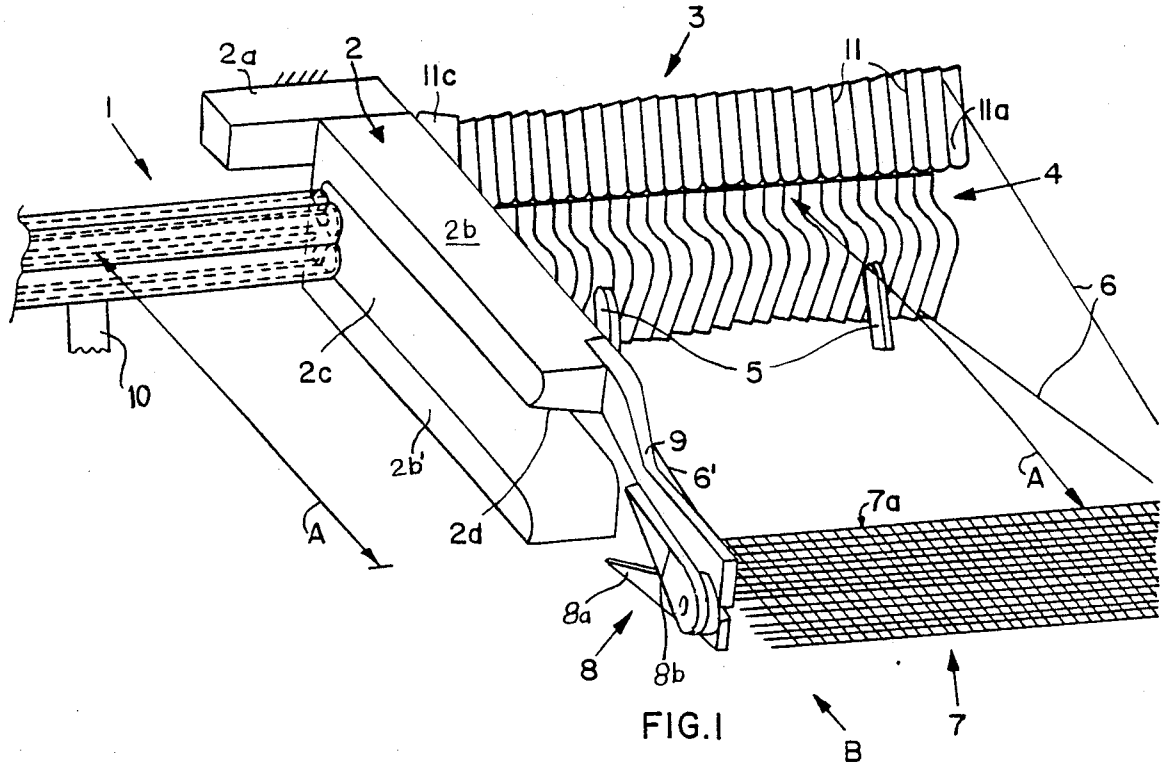
FIG. 1 is a perspective view partially broken away, of a reed with weft thread insertion nozzles and a weft thread alignment device according to the invention.

FIG. 1 shows a bundle of blow nozzles 1 mounted to a reed beam RB by a bracket 10, for introducing weft threads into a guide channel 4 formed in a reed 3 by a plurality of reed teeth 11 or rather by the projections 11*a* and 11*b* which each reed tooth 11 has. Additional nozzles, so-called relay nozzles 5 are arranged along the reed for supporting and carrying the weft thread, not shown, through the guide channel 4. The presence or absence of such relay nozzles is not critical for the invention.

The loom shed is indicated by warp threads 6 and the fabric woven is shown at 7. A lower left warp thread 6' appears just behind a guide arm 9 to be described in more detail below. A beat-up edge 7*a* faces the reed 3. The reed teeth 11 guide the warp threads 6 as is conventional. The bundle of blow nozzles 1 shall, for example, comprise four blow nozzles. Three such nozzles are visible in FIG. 1. Each nozzle has a blow channel indicated by dashed lines. The blow nozzles are only shown symbolically since any type of blow nozzle capable of inserting the weft thread into the guide channel 4 is suitable for the present invention. The width of the guide channel 4 in the vertical direction is smaller than the diameter of the blow nozzle bundle 1. Two double arrows A indicate the beat-up motion of the reed 3. These arrows are to indicate that the blow nozzle bundle 1 and the reed 3 pivot in unison back and forth during the beat-up motion to push the weft thread against the beat-up edge 7*a*.

A weft thread cutting scissors 8 is arranged along the left-hand edge of the fabric 7. The control for the scissors 8 is not shown, nor described, since it is conventional. The scissors 8 are located as close as possible to the edge of the fabric 7 to make any weft thread waste as small as possible. The scissors 8 have a lower cutting blade 8*a* and an upper cutting blade 8*b* as is conventional.

Figure 2:
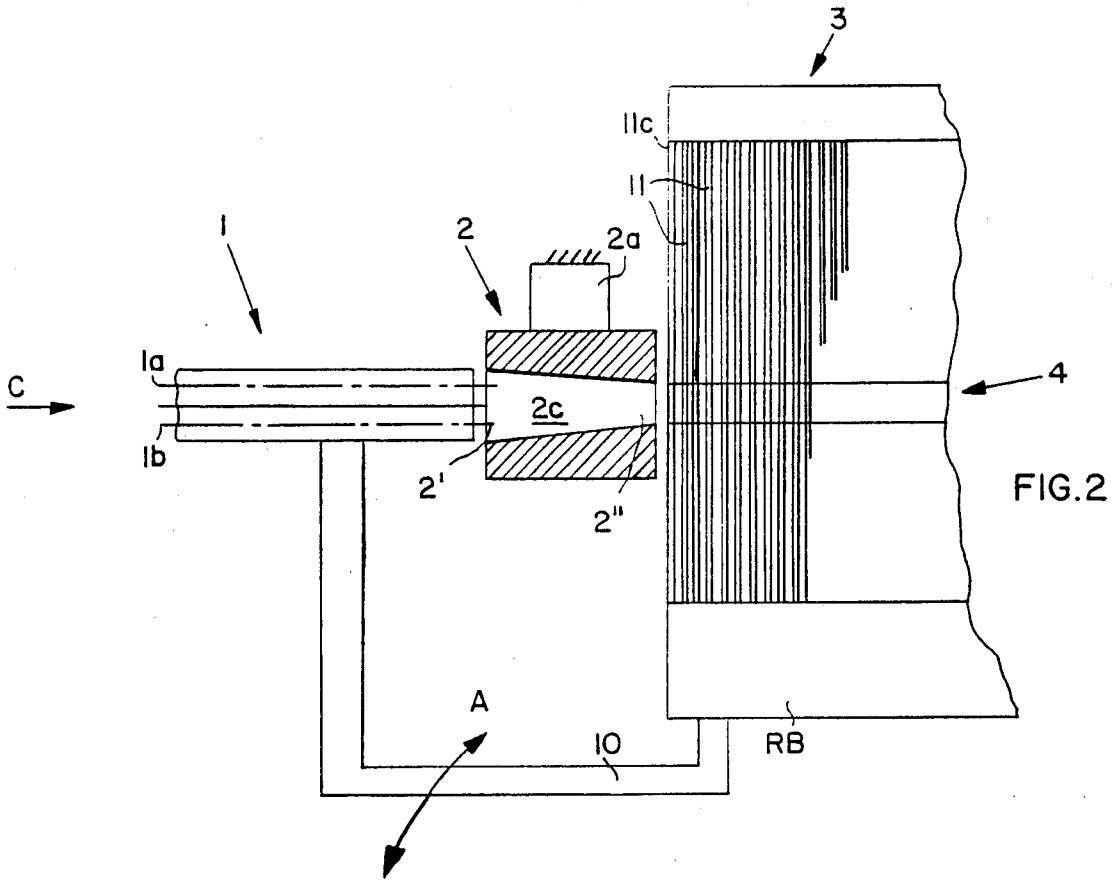
FIG. 2 is a view in the direction of the arrow B in FIG. 1 and showing the weft thread alignment device in section.
Figure 4:
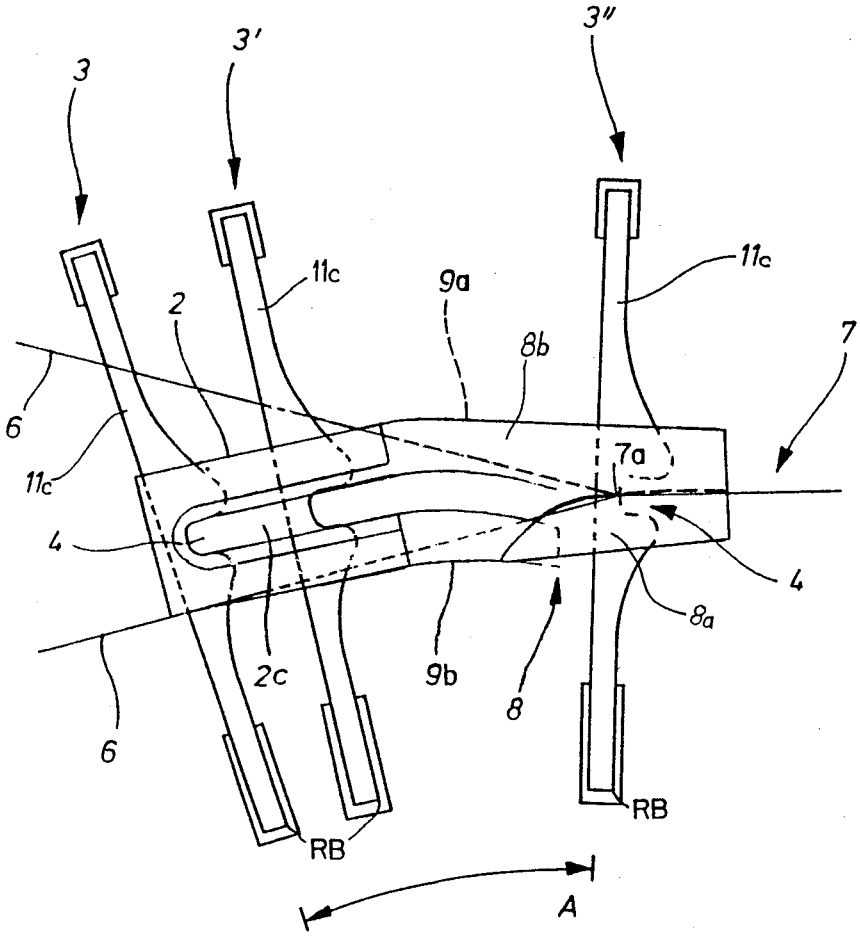
FIG. 4 is a view similar to that of FIG. 3, but showing a modified embodiment with a weft thread guide bail.

According to the invention the spacing between the right-hand end of the blow nozzle bundle 1 and the left-hand inlet into the reed 3 is occupied by a weft thread alignment device 2 mounted to the machine frame by a mounting member 2*a*. The machine frame itself is not shown. Any spacing between the alignment device 2 and the nozzle bundle 1 on the one hand, and between th alignment device 2 and the first reed tooth 11*c* of the reed 3 is kept as small as possible. The alignment device 2 comprises a two pronged block having an upper prong 2*b* and a lower prong 2*b*' forming a slot 2*c* between the prongs 2*b* and 2*b*'. The slot 2*c* has an open end 2*d*. As best seen in FIG. 2, the slot 2*c* has an inlet end 2' and an outlet end 2" as viewed in the weft insertion direction which is from left to right as viewed in FIGS. 1 and 2. The inlet end 2' has a larger vertical width than the outlet end, thereby forming a funnel-type configuration. The width of the inlet opening 2' corresponds substantially to the diameter of the nozzle bundle 1. The width at the outlet end 2" corresponds approximately to the diameter of the guide channel 4. The length of the slot in the direction of the double arrow A in FIG. 1 equals, for example, to about half of the pivoting motion of the reed as best seen in FIG. 4. The open end 2*d* of the slot 2*c* faces toward the scissors 8. When the reed performs the beat-up motion, the respective weft thread can be carried into the scissors 8 through the open slot end 2*d*.

Figure 3:
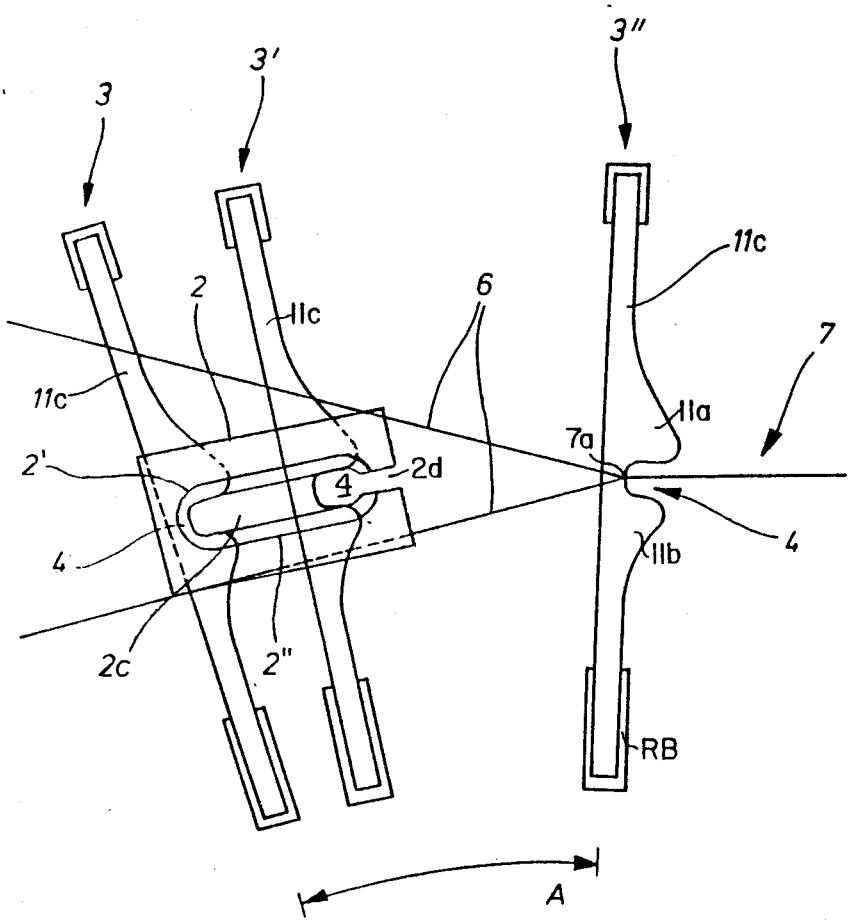
FIG. 3 is a simplified illustration of the reed as viewed in the weft thread inserting direction perpendicularly to the plane defined by the sheet of the drawing, illustrating the reed in three different positions, and as viewed in the direction of the arrow C in FIG. 2.

The length of the slot 2*c* according to the invention in the direction of the beat-up motion of the reed has the advantage that a weft thread insertion is also possible even when the reed is in its rest position to the left in FIG. 3. As a result, the time duration available for the weft thread insertion is increased. Such increase is further enhanced by the duration of time during which the reed 3 passes along the slot 2*c* on its beat-up motion and on its return motion or at least a portion of these motions. Since the alignment device 2 is stationary as taught by the invention, any damage to the scissors 8 is prevented.

FIG. 1 also shows the above mentioned weft thread guide arm 9 reaching from the upper prong 2*b* of the alignment block 2 to the scissors 8. The guide arm 9 may carry the scissors, or a portion thereof and guides the weft thread into the scissors. FIG. 1 only shows an upper guide arm 9. However, a lower guide arm may also be used as is indicated in FIG. 4 to be described in more detail below. In both instances the guide arm 9 prevents the weft thread from jumping out of its intended path. This guiding is especially advantageous where brittle yarns are involved.

FIG. 2 is a view onto FIG. 1, in the direction of the arrow B shown in FIG. 1 with the alignment device 2 shown in section. Two blow nozzles are visible of the blow nozzle bundle 1. Each nozzle carries one weft thread 1*a* and 1*b* indicated by the dashed dotted lines. FIG. 2 clearly shows the funnel-shaped configuration of the slot 2*c* with its large size entrance opening 2' and its reduced size exit opening 2". As mentioned, the exit opening 2" has a vertical width corresponding approximately to the diameter of the guide channel 4. Thus, the alignment device 2 funnels the weft threads into the proper path through the guide channel 4. As mentioned above the reed 3 with its reed beam RB is operatively connected to the nozzle bundle 1 by the mechanical connection bracket 10 so that the tilting or beat-up motions of the reed 3 are also performed by the nozzle bundle 1. The alignment device 2 is rigidly connected to the stationary frame member 2*a*.

FIG. 3 shows the reed 3 in three different positions. The position 3 is the starting position. The position 3' is an intermediate position during the beat-up movement. The position 3" is the end position of the beat-up movement when the weft thread has been beat-up against the edge 7*a* of the fabric 7. Each reed tooth 11*c* has two projections 11*a* and 11*b* to form the guide channel 4. The position of the loom shed is indicated by two warp threads 6.

As mentioned, the alignment slot 2*c* has an open end 2*d* facing toward the beat-up edge 7*a* and to the scissors not shown in FIG. 3. The funnel-shaped configuration of the slot 2*c* is again indicated by the larger entrance opening 2' and the smaller exit opening 2". Due to the elongation of the alignment slot 2*c* in the direction of the beat-up motion A, the weft thread alignment takes place at least during a portion of the beat-up motion so that the proper insertion of the weft thread into the most advantageous path through the guide channel 4 is assured. Thus, the time duration needed for the reed to travel from position 3 to 3' becomes available for the proper weft thread insertion. As a result, the r.p.m. of the loom can be increased and the efficiency of the loom respectively improved.

FIG. 4 shows a view similar to that of FIG. 3 and further illustrating the position of the scissors 8 in front of the reed when the latter is in its beat-up position 3'' beating the weft thread against the edge 7*a*. In FIG. 4 the weft thread guide arm comprises an upper guide member 9*a* and a lower guide member 9*b*. Both guide arm members 9*a* and 9*b* extend, so to speak, the slot 2*c* all the way to the scissors 8. The type of guide arm that will be used with one or two members in any particular instance will depend on the type of yarn used.

Figure 5:
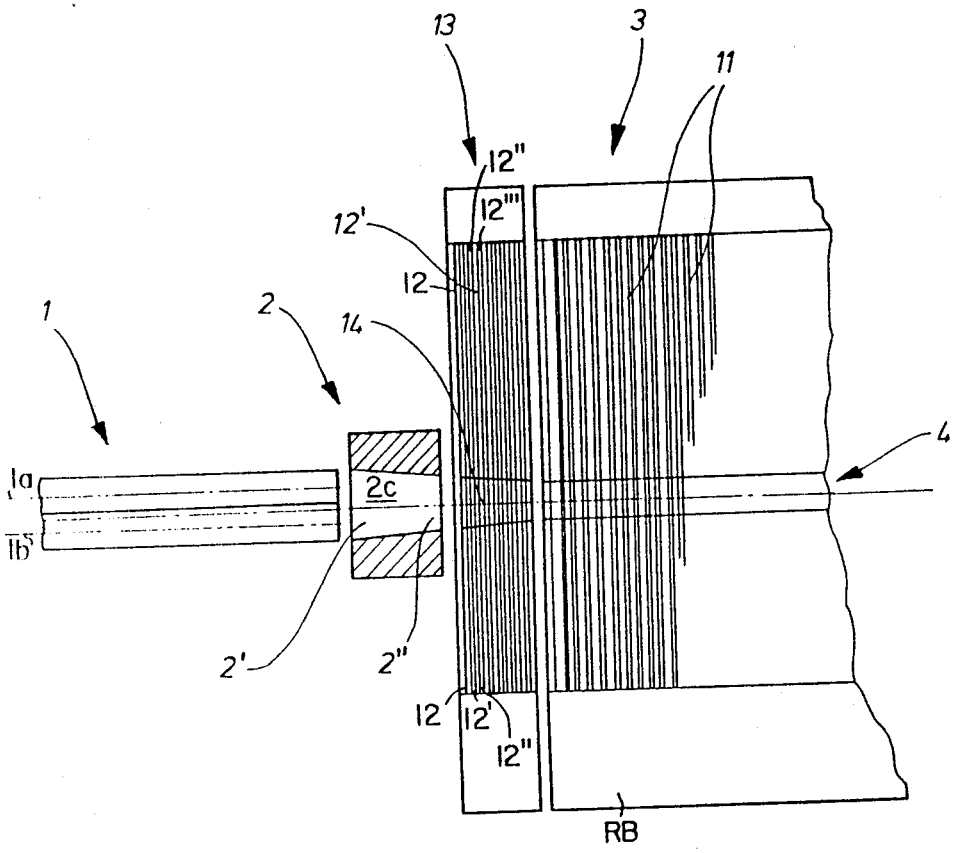
FIG. 5 is a view similar to that of FIG. 2, but showing an auxiliary reed forming a guide channel which forms an extension of the present alignment device.

FIG. 5 is a view similar to that of FIG. 2, but showing a modification with an auxiliary reed 13. Due to the use of the auxiliary reed 13 with special reed teeth 12,as will be described below with reference to FIG. 6, it is possible to provide in the auxiliary reed 13 a conically shaped inlet funnel 14 for the guide channel 4 of the reed 3. As a result, the alignment device 2 may be shorter in the weft thread insertion direction, because the funnel of the slot 2*c* and the funnel-shaped inlet 14 of the guide channel together form a sufficient length for the alignment of the weft threads 1*a*, 1*b* even though the total length is provided by two separate structural components, namely the alignment device 2 and the auxiliary reed 13.

Figure 6:
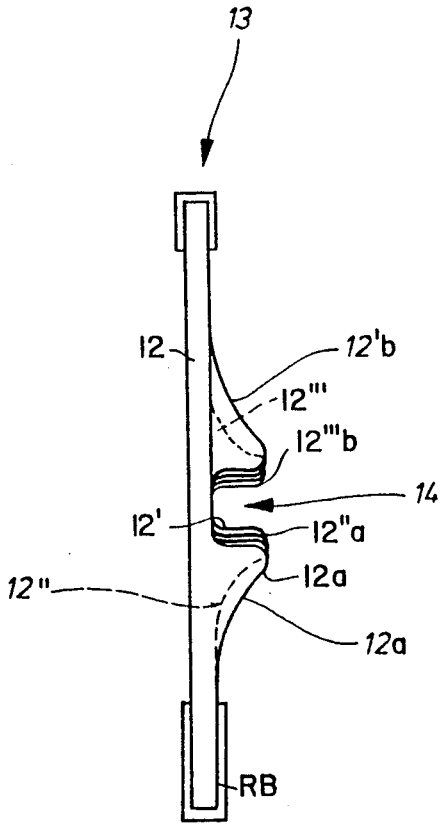
FIG. 6 is a side view in the direction of the weft thread advance onto the auxiliary reed of FIG. 5.

FIG. 6 shows a view into the auxiliary reed 13 in the direction of the weft thread insertion. Only four reed teeth are shown, namely 12, 12', 12'', and 12'''. Each reed tooth has only one guide channel forming projection which either faces upwardly as the projection 12*a* of the reed tooth 12, and the projection 12''*a* of the reed tooth 12'', or downwardly as the projection 12'*b* of the reed tooth 12' or the projection 12'''*b* of the reed tooth 12'''. Thus, the just mentioned guide channel forming projections are arranged alternately above and below a weft thread travel path through the guide channel, as shown in FIG. 6. The upwardly and donwardly facing edges are so located that the inlet funnel 14 results as shown in both FIGS. 5 and 6. This slant to form the conical inlet funnel 14 is achieved by respectively displacing the corresponding reed teeth upwardly or downwardly. In this manner, the auxiliary reed 13 with its conical-shaped guide channel inlet funnel 14 is easily manufactured without the need for the formation of special reed teeth.

Although the invention has been described with reference to specific example embodiments,it is to be appreciated that it is intended to cover all modifications and equivalents within the scope of the appended claims.

What we claim is:

1. A weft thread inserting device for a pneumatic loom, comprising at least two thread inserting blowing nozzles forming a nozzle bundle and reed means having reed teeth forming a weft thread guide channel, means (10) securing said nozzle bundle to said reed means for moving with said reed means, stationary weft thread alignment means having an alignment opening formed as a funnel-type slot (2*c*) for leading weft threads into said guide channel, means mounting said stationary weft thread alignment means in a fixed position in a gap between said bundle of blowing nozzles and said weft thread guide channel of said reed teeth, said alignment slot (2*c*) of said stationary alignment means having a length in the direction of a beat-up motion of said reed, said length being sufficient for increasing the time duration available for a weft thread insertion into said weft thread guide channel while said reed means performs a beat-up motion.

2. The device of claim 1, wherein said mounting means locate said alignment means directly next to an end of said blowing nozzles so that said alignment means substantially completely bridge said gap.

3. The device of claim 1, wherein said funnel-type slot has a laterally open end toward a beat-up edge of a fabric being woven by said loom.

4. The device of claim 3, further comprising weft thread cutting scissors arranged opposite said open end of said funnel-type slot for cutting a weft thread coming out of said open end of said funnel-type slot, and thread guide bail means bridging said alignment means with said scissors for leading a weft thread into said scissors.

5. The device of claim 1, wherein said reed teeth forming said weft thread guide channel have guide channel forming projections so arranged that an inlet end of said guide channel forms a channel inlet funnel (14).

6. The device of claim 5, wherein said guide channel forming projection of said reed teeth are arranged alternately above and below a weft thread travel path through said guide channel.

7. The device of claim 5, wherein each of said reed teeth has one projection for forming said guide channel, and wherein said reed teeth form two groups of reed teeth, one group having reed teeth each of which has an upper projection for defining said guide channel, and another group having reed teeth each of which has a lower projection for defining said guide channel, and wherein reed teeth from one group alternate with reed teeth from the other group along the length of said guide channel.

8. The device of claim 5, wherein said channel inlet funnel comprises reed teeth combined to form a separate auxiliary reed (13) located immediately downstream of said weft thread alignment means as viewed in the weft thread advance direction.

* * * * *